US006091344A

United States Patent [19]

Park et al.

[11] Patent Number: 6,091,344

[45] Date of Patent: Jul. 18, 2000

[54] COMMUNICATION PROCESSING DEVICE OF TOLL COLLECTING SYSTEM

[75] Inventors: Won-seo Park, Sungnam; Ho-cheol Kim, Seoul; Duk-kyun Ryu, Kwacheon; Seog-min Choi, Seoul, all of Rep. of Korea

[73] Assignee: SamSung Electronics Co., Ltd., Suwon, Rep. of Korea

[21] Appl. No.: 09/062,711

[22] Filed: Apr. 20, 1998

[30] Foreign Application Priority Data

Apr. 18, 1997 [KR] Rep. of Korea ..... 97-14457

[51] Int. Cl.[7] ..... G08G 1/00

[52] U.S. Cl. ..... 340/928; 340/933; 235/384; 701/117

[58] Field of Search ..... 340/928, 933, 340/905; 235/382, 384, 379, 380; 701/117

[56] References Cited

U.S. PATENT DOCUMENTS

| | | | |
|---|---|---|---|
| 3,705,976 | 12/1972 | Platzmen . | |
| 4,555,618 | 11/1985 | Riskin . | |
| 4,675,824 | 6/1987 | Kiyama et al. . | |
| 4,845,636 | 7/1989 | Walker . | |
| 5,204,964 | 4/1993 | Crouch . | |
| 5,289,183 | 2/1994 | Hassett et al. . | |
| 5,414,624 | 5/1995 | Anthonyson . | |
| 5,451,755 | 9/1995 | Duval et al. . | |
| 5,451,758 | 9/1995 | Jesadanont | 235/384 |
| 5,485,520 | 1/1996 | Chaum et al. . | |
| 5,488,360 | 1/1996 | Ray | 340/933 |
| 5,514,857 | 5/1996 | Corless . | |
| 5,554,984 | 9/1996 | Shigenaga et al. . | |
| 5,602,375 | 2/1997 | Sunahara et al. . | |
| 5,640,156 | 6/1997 | Okuda et al. | 340/928 |
| 5,663,548 | 9/1997 | Hayashi et al. . | |
| 5,705,996 | 1/1998 | Eguchi et al. . | |
| 5,710,702 | 1/1998 | Hayashi et al. . | |
| 5,737,710 | 4/1998 | Anthonyson | 701/1 |
| 5,805,082 | 9/1998 | Hassett | 340/928 |
| 5,825,007 | 10/1998 | Jesadanont . | |
| 5,872,525 | 2/1999 | Fukasawa et al. | 340/928 |

FOREIGN PATENT DOCUMENTS

| | | |
|---|---|---|
| 63-111574 | 5/1988 | Japan . |
| 5-217044 | 8/1993 | Japan . |

*Primary Examiner*—Jeffrey A. Hofsass
*Assistant Examiner*—Anh La
*Attorney, Agent, or Firm*—Robert E. Bushnell, Esq.

[57] ABSTRACT

A communication processing device in a booth computer of a toll collecting system includes a communication firmware portion for transmitting data to and receiving data from a predetermined number of lane controllers which control equipments installed respectively in toll collection lanes and detecting and correcting errors in communication, a lane controller interface for analyzing the data transmitted from the communication firmware portion, distributing the data to various processing devices in the booth computer, and transmitting predetermined commands and data from the processing devices in the booth computer to the lane controllers through the communication firmware portion, a lower interface operating state managing portion for receiving commands on a communication operation from a user, controlling a communication state, and providing the result to the user, and a booth controller interface for transmitting to a booth controller initializing data representing the state of each lane, booth control data including the equipment state of each lane received from the lane controller interface, and working state data transmitted from the lower interface operating state managing portion. According to the communication processing device, the operating state of the lane controller can be monitored in real time and the booth computer controlling the toll collecting system can transmit data to and receive data from various lane controllers, a booth controller, and peripheral equipment connected thereto.

20 Claims, 7 Drawing Sheets

COMMUNICATION PROCESSING DEVICE OF TOLL COLLECTING SYSTEM

CLAIM FOR PRIORITY

This application makes reference to, incorporates the same herein, and claims all benefits accruing under 35 U.S.C. § 119 from an application for COMMUNICATION PROCESSING DEVICE OF TOLL COLLECTING SYSTEM earlier filed in the Korean Industrial Property Office on Apr. 18, 1997, and there duly assigned Ser. No. 14457/1997, a copy of which application is annexed hereto.

BACKGROUND OF THE INVENTION

1. Technical Field

The present invention relates to a communication processing device, and more particularly, to a communication processing device included in a booth computer of a toll collecting system for communicating with a lane controller installed in each lane, collecting materials for the traffic of vehicles in each lane, and transferring information required for operating the lane controller such as a toll table, a basic item table, and a void credit, void exemption, and void discount card table.

2. Related Art

Contemporary toll collecting systems for toll collection of vehicles on toll roads such as expressways may be classified as a closed type or an open type of system according to a particular management pattern. A closed type toll collecting system relates to toll collection of a vehicle at the toll gate where the value of the toll is determined according to the type of vehicle and the distance traveled along the road. An open type toll collecting system relates to toll collection determined according to only the type of the vehicle.

On toll roads for vehicles on which the toll depends upon the distance traveled along the road of traditional closed type toll collecting systems such as disclosed in U.S. Pat. No. 3,705,976 for Revenue Control System For Toll Roads issued to Platzman, U.S. Pat. No. 4,555,618 for Method And Means For Collecting Highway Tolls issued to Riskin, and U.S. Pat. No. 4,675,824 for Method Of Replacing A Tolling System For Toll Roads issued to Kiyama et al., the collection of tolls requires an attendant at each toll gate of the toll road. Usually when a vehicle is about to enter a toll road, the driver of the vehicle must stop at an entrance toll gate to pick up a ticket for toll collection upon exit. Sometimes, an attendant is required at the toll gate to input information relating to the type of vehicle into a ticket machine for ticket issuance which the attendant hands to the driver. Typically the ticket may be a magnetic recorded pass or contains punched holes in which information such as the date, the toll gate number, and the type of vehicle is encoded. Upon receipt of the ticket, the driver can enter the toll road with his vehicle.

When the driver wishes to exit from the toll road, he or she must stop at an exit toll gate and hand the ticket to an attendant at the toll gate. The attendant then inserts the ticket into a card reader which deciphers the information encoded in the punched holes of the ticket or reads the magnetic strip for toll calculation. The attendant must manually collect the toll from the driver of the vehicle before the driver can exit from the toll road. Since the toll collecting process requires human attendants, the time required to collect the toll for each vehicle is extremely exhaustive, costly and 5 frequently causes traffic backups on the toll road near the entrances and exits. The traffic jams in turn cause pollution because of the amount of carbon monoxide that is produced, and the amount of fuel that is consumed by thousands and thousands of vehicles that must come to a full stop, stop and go, and then accelerate for the duration.

In recent years, electronics have been used for more cost efficient and reliable toll collections such as those disclosed in U.S. Pat. No. 5,485,520 for Automatic Real-Time Highway Toll Collection From Moving Vehicles issued to Chaum et al., U.S. Pat. No. 5,554,984 for Electronic Traffic Tariff Reception System And Vehicle Identification Apparatus issued to Shigenaga et al., U.S. Pat. No. 5,602,375 for Automatic Debiting System Suitable For Free Lane Traveling issued to Sunahara et al., U.S. Pat. No. 5,663,548 for Vehicle Carried Unit for Automatic Toll-Paying Systems And Automatic Toll-Receiving Apparatus issued to Hayashi et al., U.S. Pat. No. 5,705,996 for Toll Collection System issued to Eguchi et al., and U.S. Pat. No. 5,710,702 for Apparatus For Transmitting Information For Vehicle issued to Hayashi et al. Many recent toll collecting systems use an on-board unit installed in the vehicle for toll collection without stopping the vehicle at the toll gate by way of radio communication equipment installed at the entrance/exit toll gate. However, I have noted that the on-board unit must be installed in the vehicle, and the efficiency of the toll gate lane is lowered if there are few vehicles equipped with the on-board units. Rather, toll collection efficiency can significantly be improved for both closed type and open type of toll collection systems if a central communication device is provided to effectively communicate with lane controllers, booth controllers and peripheral equipments connected to booth computers.

SUMMARY OF THE INVENTION

Accordingly, it is therefore an object of the present invention to provide an improved toll collecting system and a method for efficient toll collection of vehicles on toll roads.

It is also an object to provide a communication processing device of a toll collecting system for effectively facilitating communication between lane controllers, booth controllers and peripheral equipments connected to booth computers for toll collection.

It is further an object to provide a communication processing device of a toll collection system with a booth computer effectively transmits data to and receives data from various lane controllers, booth controllers, and connected peripheral equipments of the toll collecting system.

These and other objects of the present invention can be achieved by a communication processing device included in a booth computer for controlling the entire toll collecting operation in a toll collecting system, comprising a communication firmware portion for transmitting data to and receiving data from a predetermined number of lane controllers which control equipments installed respectively in toll collection lanes and detecting and correcting errors in communication, a lane controller interface for analyzing the data transmitted from the communication firmware portion, distributing the data to various processing devices in the booth computer, and transmitting predetermined commands and data from the processing devices in the booth computer to the lane controllers through the communication firmware portion, a lower interface operating state managing portion for receiving commands on a communication operation from a user, controlling a communication state, and providing the result to the user, and a booth controller interface for transmitting to a booth controller initializing data representing the state of each lane, booth control data including the equipment state of each lane received from the lane controller interface, and working state data transmitted from the lower interface operating state managing portion.

The present invention is more specifically described in the following paragraphs by reference to the drawings attached only by way of example.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
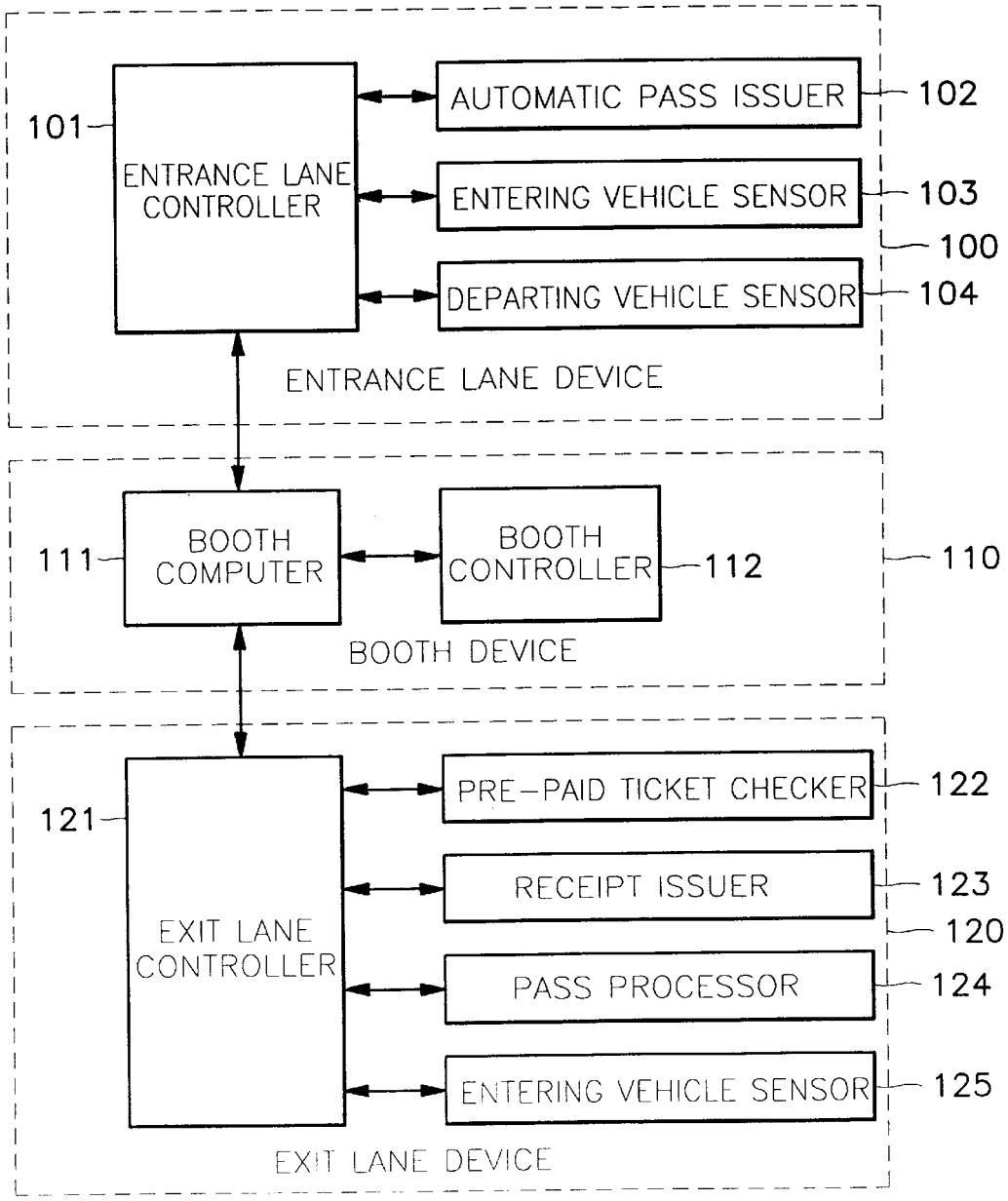
FIG. 1 is a block diagram of a closed type toll collecting system.

Referring now to the drawings and particularly to FIG. 1, which illustrates the structure of a closed type toll collecting system for collecting toll according to the kind of vehicle and the distance traveled on the expressway from an entrance toll gate to an exit toll gate. As shown in FIG. 1, the closed type toll collecting system includes an entrance land device 100, a booth device 110, and an exit lane device 120.

The entrance lane device 100 installed in an entrance lane of an expressway includes an automatic pass issuer 102 for automatically issuing a pass to the driver, an entering vehicle sensor 103 for sensing a vehicle entering the entrance lane, a departing vehicle sensor 104 for sensing a vehicle departing from the entrance lane, and an entrance lane controller 101 for controlling operation of the automatic pass issuer 102, the entering vehicle sensor 103, and the departing vehicle sensor 104. The entrance lane controller 101 is also connected to the booth computer 111. Through the control of the booth computer 111, the entrance lane controller 101 transfers data related to the entrance lane to the booth computer 111. The entrance lane controller 101 may alternatively be installed inside the automatic pass issuer 102.

The booth device 110 includes a booth computer 111 for managing the entire toll collecting operation of each booth and a booth controller 1 12 for displaying the state of the equipment in each lane and the working state of workers.

The exit lane device 120 installed in the exit lane of the expressway includes a pass processor 124 for receiving and processing a pass from the driver, a pre-paid ticket processor (pre-paid ticket checker) 122 for processing a pre-paid ticket in the case that the toll is paid by the pre-paid ticket, a receipt issuer 123 for issuing a receipt for the toll, an entering vehicle sensor 125 for sensing a vehicle entering the exit lane, and an exit lane controller 121 connected to the above equipment, for controlling them. The exit lane controller 121 transfers data related to the exit lane to the booth computer 111, like the entrance lane controller 101, and is controlled by the booth computer 111.

Figure 2:
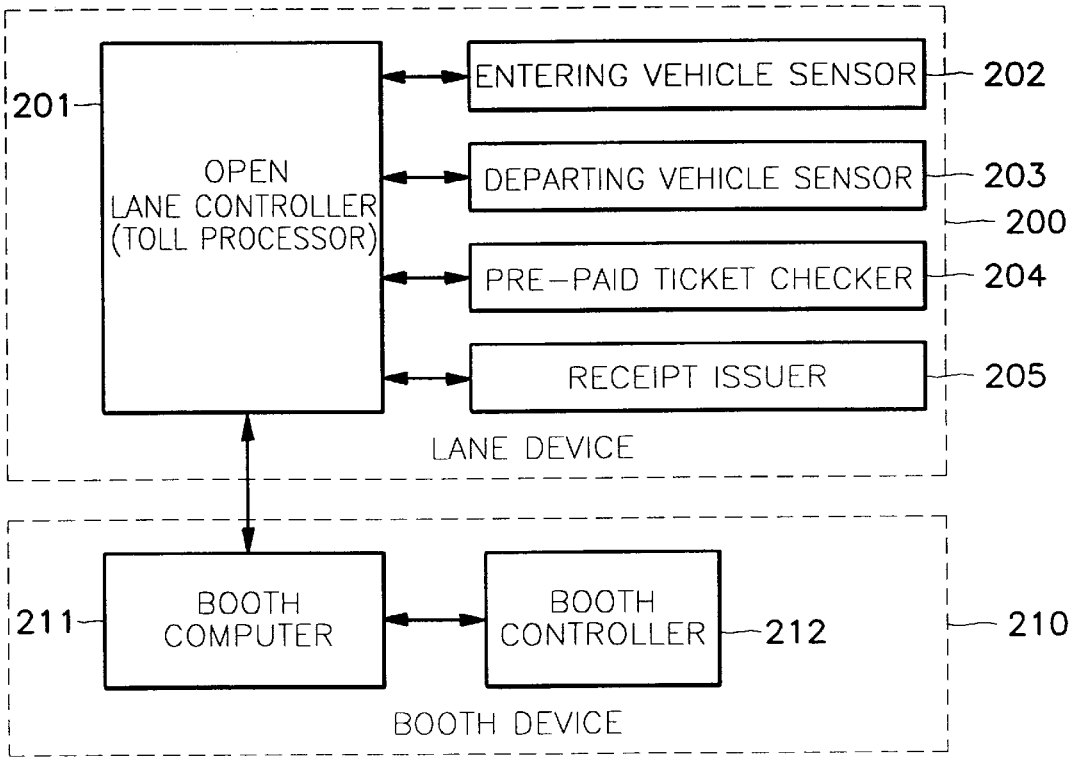
FIG. 2 is a block diagram of an open type toll collecting system.

FIG. 2 is a block diagram showing the structure of an open type toll collecting system which collects a predetermined toll from a vehicle which passes through a toll gate according to the kind of the vehicle. As shown in FIG. 2, open toll collecting system includes a booth device 210 and a lane device 200.

In the open toll collecting system, the booth device 210 is similar to the booth device 110 of the closed-type toll collecting system. However, the lane device 200 of the open type toll collecting system is incorporated in one lane device whereas the closed system includes the entrance lane device 100 and the exit lane device 120 separately. The lane device 200 of the open system includes an entering vehicle sensor 202, a departing vehicle sensor 203, a pre-paid ticket processor 204, a receipt issuer 205, and an open lane controller 201 including a toll processor inside, for controlling the above equipment. Accordingly, in the booth computers 111 and 211, a communication processing device for effectively transmitting data to and receiving data from the lane controllers 101, 121, and 201, the booth controllers 112 and 212, and peripheral equipment connected to the booth computers 111 and 211 is required.

Figure 3:
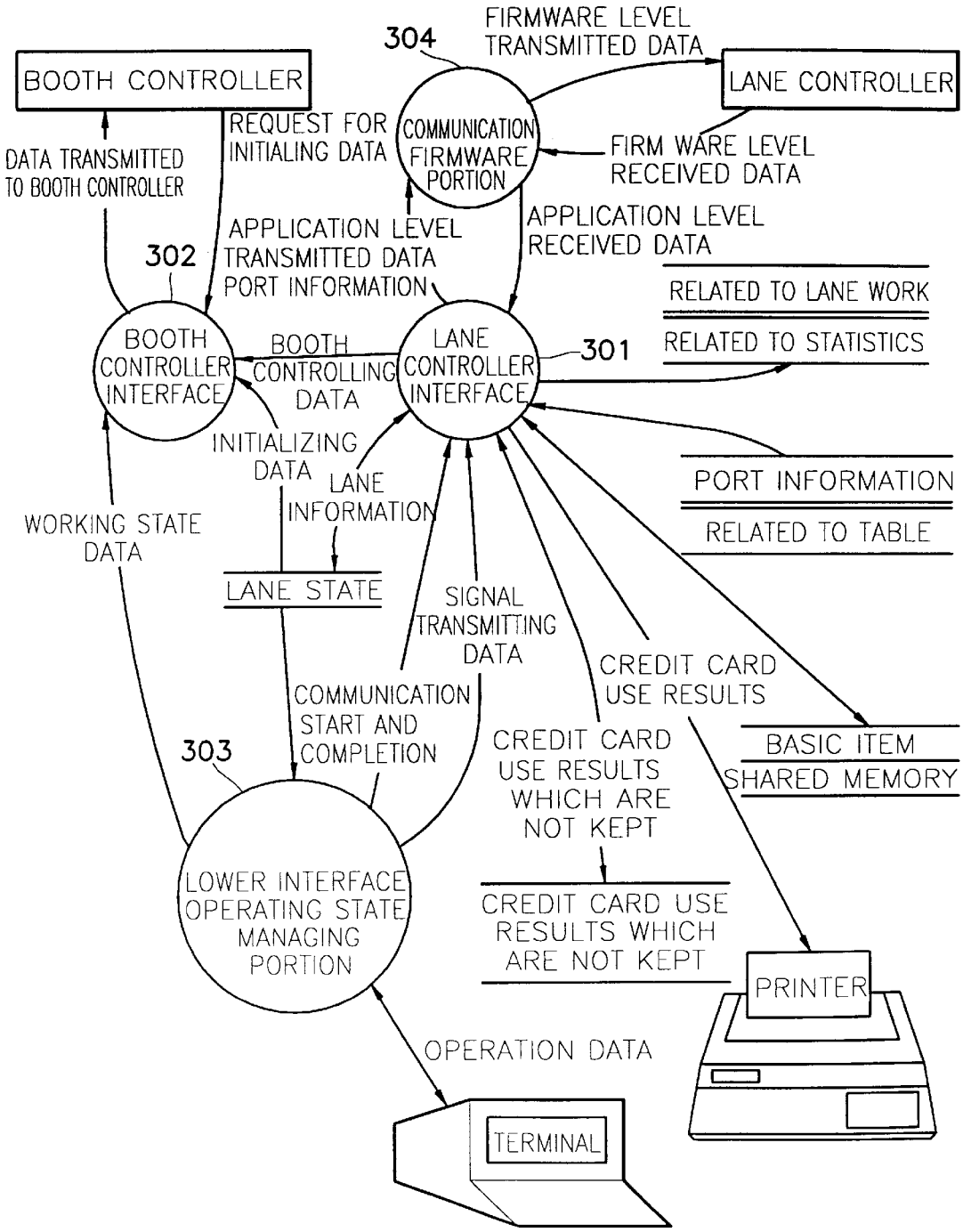
FIG. 3 is a block diagram of the structure of a communication processing device in a toll collecting system constructed according to the principles of the present invention.

Turning now to FIG. 3 which illustrates a communication processing device in a toll collecting system according to the principles of the present invention. The communication processing device in the toll collecting system includes a lane controller interface 301, a booth controller interface 302, a lower interface operating state managing portion 303, and a communication firmware portion 304. These portions are software/firmware modules which operate in the booth computer which is an element of the toll collecting system.

The lane controller interface 301 analyzes data transmitted from the communication firmware portion 304, distributes the analyzed data to the various processing devices in booth computers 111 and 211, and transmits predetermined commands and data from the various processing devices in the booth computers 111 and 211 to lane controllers 101, 121, and 201 through the communication firmware 304.

Figure 4:
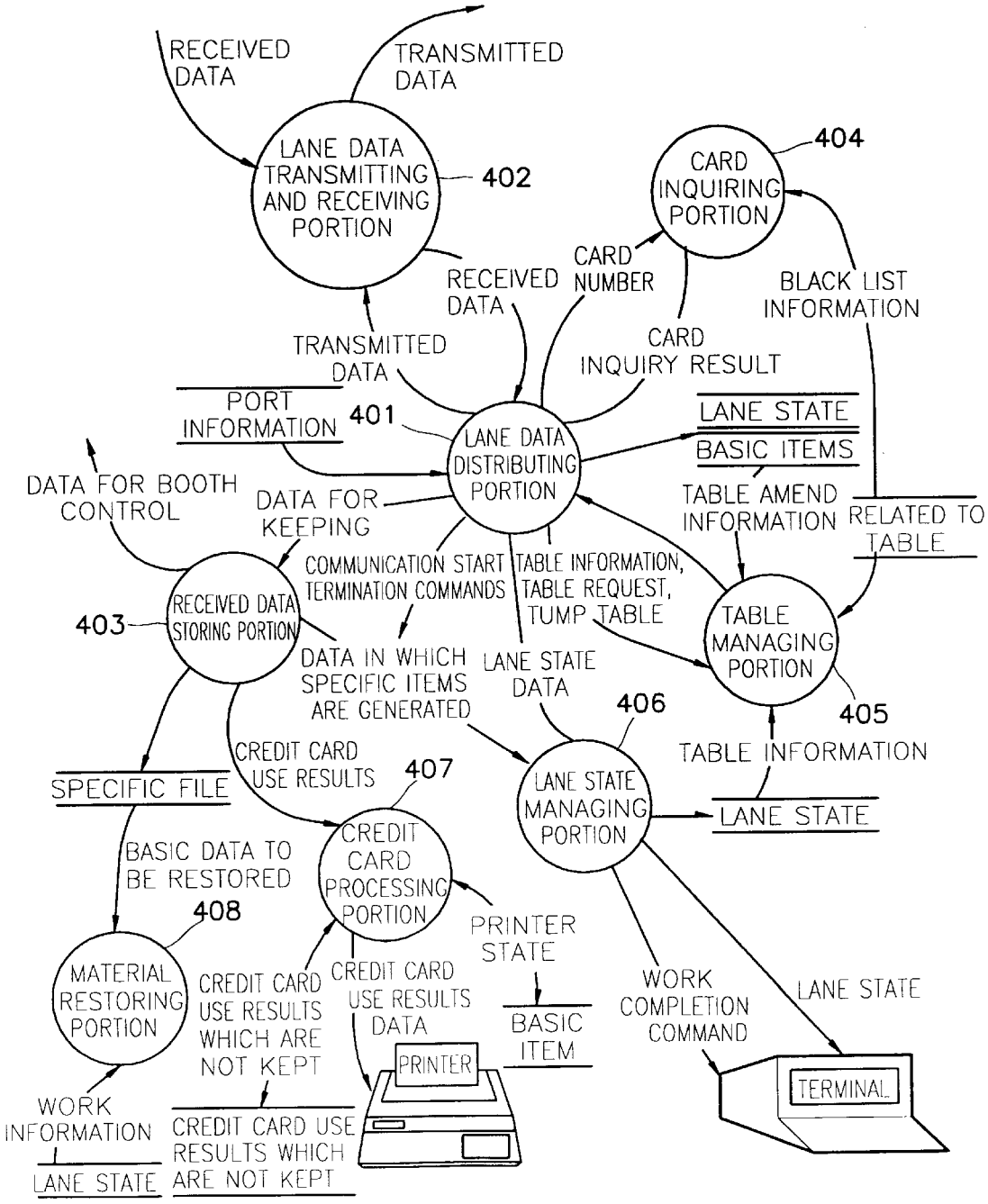
FIG. 4 is a block diagram of a lane controller interface which is an element of the present invention.

Referring to FIG. 4, a preferred embodiment of the lane controller interface 301 includes a lane data transmitting and receiving portion 402, a lane data distributing portion 401, a received data storing portion 403, a card inquiring portion 404, a table managing portion 405, a lane state managing portion 406, a credit card processing portion 407, and a material restoring portion 408.

The lane data transmitting and receiving portion 402 transmits lane data to and receives lane data from the communication firmware portion 304. The lane data distributing portion 401 receives lane data from the lane data transmitting and receiving portion 402, determines the kind of the lane data, and distributes the lane data to a concerned processing module. In the case that the lane data received by the lane data distributing portion 401 is a card number, the card inquiring portion 404 inquires whether the card number is included in a blacklist which is a list of card numbers prohibited from being used and indicates the result. The table managing portion 405 adds, deletes, changes, and searches for items included in various tables, including a lane state basic item, a card blacklist, and a lane state. In the case that the lane data received by the lane data distributing portion 401 is data to be stored, the received data storing portion 403 stores the data in a detailed file and distributes data for the booth controller, data in which specific items are generated, and data showing credit card use results to the respective concerned processing modules among the data to be stored. The lane state managing portion 406 receives the lane state data from the lane data distributing portion 401 and the data in which specific items are generated from the received data storing portion 403, and records in a lane state file, provides the same to a user, or generates work completion command. The credit card processing portion 407 receives the data showing credit card use results from the received data storing portion 403, processes the same on-line, and records the contents in a file. When there is something wrong with the lane state file or the detailed file, the material restoring portion 408 restores the contents thereof.

The booth controller interface 302 transmits initializing data of the lane state of each lane, booth controlling data including the state of equipment in each lane, received from the lane controller interface 301, and working state data received from the lower interface operating state managing portion 303, to the booth controllers 112 and 212.

Figure 5:
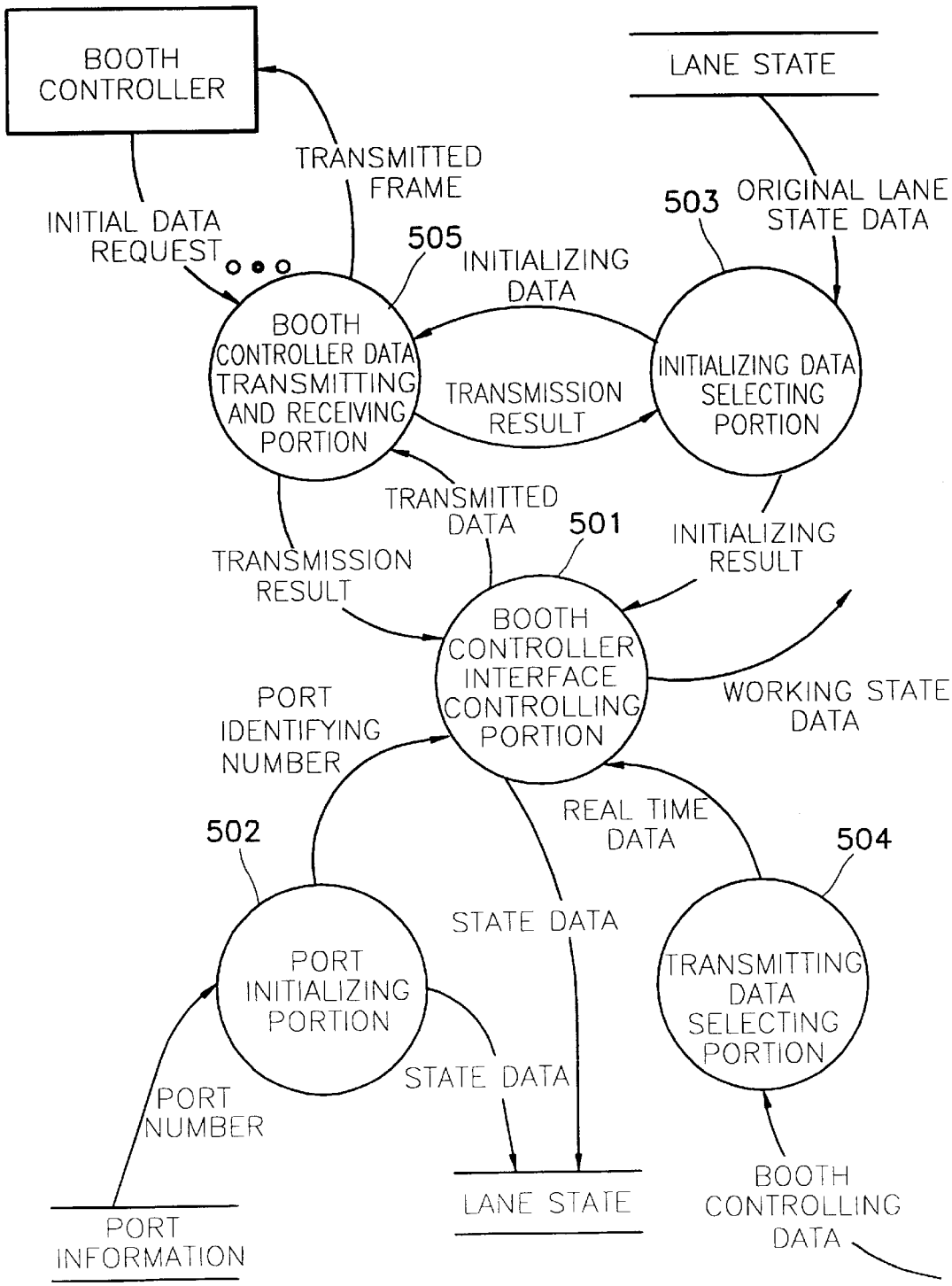
FIG. 5 is a block diagram of a booth controller interface which is an element of the present invention.

Referring to FIG. 5, a preferred embodiment of the booth controller interface 302 includes a booth controller interface controlling portion 501, a port initializing portion 502, an initializing data selecting portion 503, a transmitting data selecting portion 504, and a booth controller data transmitting and receiving portion 505.

The booth controller interface controlling portion 501 commands that the port initializing portion 502 be executed, transmits the booth controlling data selected by the transmitting data selecting portion 504 and the working state data received from the lower interface operating state managing portion 303 to the booth controllers 112 and 212 through the booth controller data transmitting and receiving portion 505, and receives the results through the booth controller data transmitting and receiving portion 505. The port initializing portion 502 initializes the port included in the booth controllers 112 and 212. In the case that the data signal received from the booth controller data transmitting and receiving portion 505 is a request for initializing data, the initializing data selecting portion 503 selects the initializing data of the state of each lane and transmits the same to the booth controllers 112 and 212 through the booth controller data transmitting and receiving portion 505. The transmitting data selecting portion 504 selects urgent data, from among the booth controlling data including the state of equipment in each lane received from the lane controller interface 301. The booth controller data transmitting and receiving portion 505 transmits data to and receives data from the booth controllers 112 and 212.

The lower interface operating state managing portion 303 receives commands on communication operation from a user, controls communication, and provides the result to the user.

Figure 6:
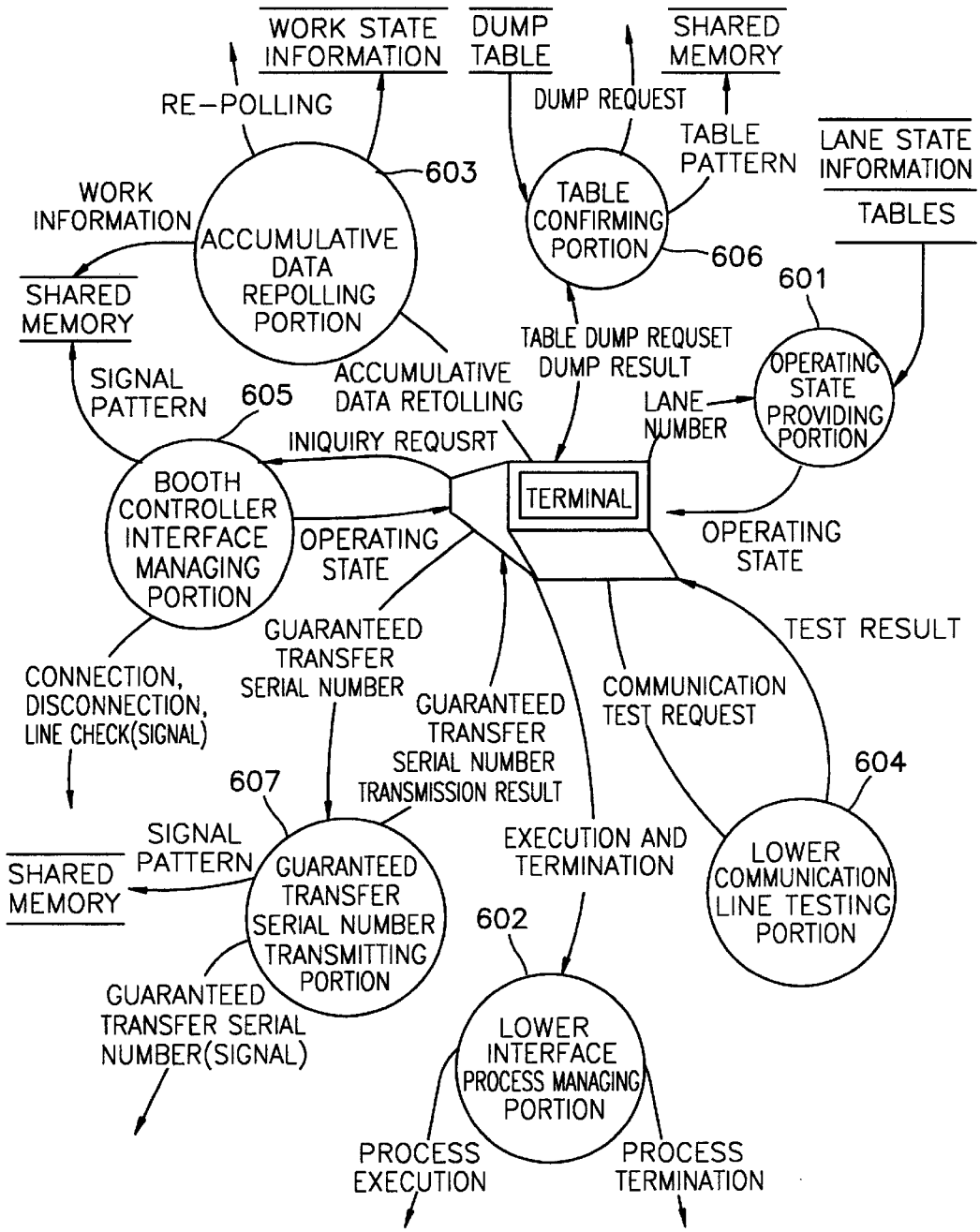
FIG. 6 is a block diagram of a lower interface operating state managing portion which is an element of the present invention.

Referring to FIG. 6, a preferred embodiment of the lower interface operating state managing portion 303 includes, an operating state providing portion 601, a lower interface process managing portion 602, an accumulated data re-polling portion 603, a lower communication line testing portion 604, a booth controller interface managing portion 605, table confirming portion 606, and a guaranteed transfer serial number transmitting portion 607.

The operating state providing portion 601 provides the state of the operation of the present lane to the user, according to the command of the user. The lower interface process managing portion 602 connects or disconnects communication with the lane controllers 101, 121, and 201 according to the commands of the user. The accumulated data re-polling portion 603 requests from the lane controller interface 301 data with respect to the working number optionally designated by the user, and displays the result to the user. The lower communication line testing portion 604 tests the state of the line for interfacing with the lane controllers 101, 121, and 201 and the operating state of the interface with peripheral equipment, according to the commands of a user. The booth controller interface managing portion 605 connects, disconnects, and tests the connection with the booth controller interface 302, according to the commands of the user. The table confirming portion 606 commands the reception of the tables kept in the lane controllers 101, 121 and 201 according to the commands of the user, compares the table kept in the lane controllers 101, 121 and 201 with the table kept in the booth computers 111 and 211, and provides the result to the user. The guaranteed transfer serial number transmitting portion 607 transmits the transfer serial number designated by the user to the lane controllers 101,121, and 201 through the lane controller interface 301, and guarantees the same.

The communication firmware portion 304 arranges the data transmitted to the lane controllers 101, 121, and 201 into frames suitable for communication, processes data received from the lane controllers 101, 121, and 201 into a format which can be easily processed in other modules, and detects and corrects errors in communication. Namely, the communication firmware portion 304 operates as a data link layer which directly communicates with the lane controllers 101, 121, and 201 and collects materials.

Figure 7:
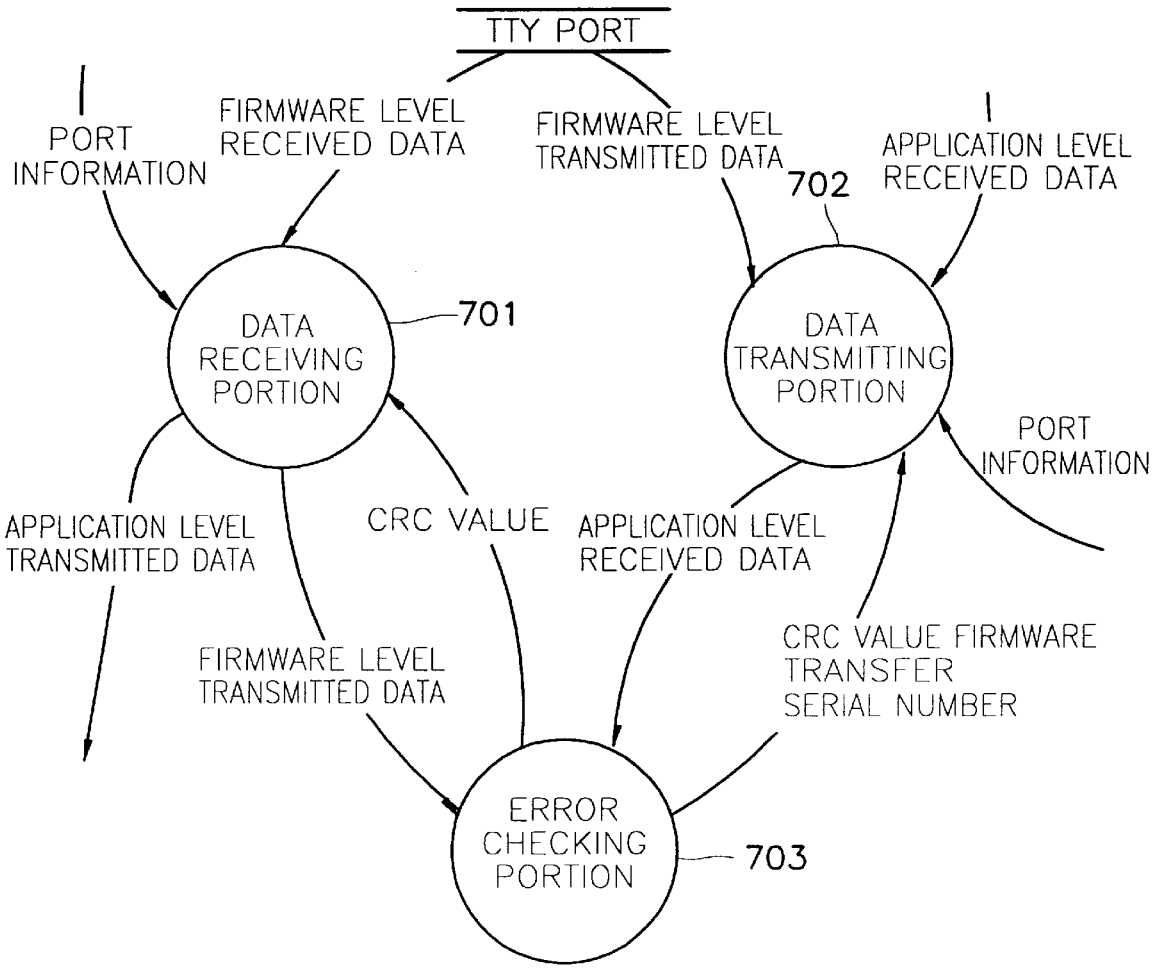
FIG. 7 is a block diagram of a communication firmware portion which is an element of the present invention.

Referring to FIG. 7, the embodiment of the communication firmware portion 304 includes a data receiving portion 701, a data transmitting portion 702, and an error checking portion 703.

The data receiving portion 701 receives data from the lane controllers 101, 121, and 201 and processes the data to allow the data to be used by the application programs in the booth computers 111 and 211. The data transmitting portion 702 constructs a transmission data frame to be transferred in a communication firmware level and transmits the data frame. The error checking portion 703 calculates the value such as a CRC (Cyclic Redundancy Check) of an error detecting code included in the transmitted and received data, and checks a transfer serial number.

Now, the operation of the present invention will be described in detail with reference to FIGS. 1 to 7 hereinbelow. First, the processes of initializing the lane controllers 101, 121, and 201 are as follows.

When the lane controllers 101, 121, and 201 installed in each lane are operated, the lane controllers 101, 121, and 201 receive periodical data polling generated in the communication processing device of the booth computers 111 and 211, and transfer initializing table polling data to the booth computers 111 and 211. The communication processing device of the toll collecting system according to the present invention receives data transmitted by the lane controllers 101, 121, and 201 through the data receiving portion 701 and transmits the same data to the lane controller interface 301. The lane data distributing portion 401 receives the data through the lane data transmitting and receiving portion 402, analyzes the data, and requests the table managing portion 405 to send a lane controller initializing table. The lane data distributing portion 401 transmits the table received from the table managing portion 405 to the communication firmware portion 304 through the lane data transmitting and receiving portion 402. The communication firmware portion 304 transfers the table to the lane controllers 101, 121, and 201 through the data transmitting portion 702.

Processes of receiving materials on vehicle sensing and toll collecting are as follows. The lane controllers 101, 121, and 201 installed in each lane receive the periodical data polling generated in the communication processing device of the booth computers 111 and 211 and, after obtaining the data and toll collecting materials with respect to the vehicle which passed through the lane controllers 101, 121, and 201, transfers the data and toll collecting materials to the booth computers 111 and 211. When the data is transferred by the lane controllers 101, 121, and 201, the communication processing device of the booth computers 111 and 211 receives the data transmitted by the lane controllers through the data receiving portion 701 of the communication firmware portion 304 and transmits it to the lane controller interface 301. The lane data distributing portion 401 receives the data through the lane data transmitting and receiving portion 402, analyzes the data, and transmits the received vehicle sensing and toll collecting materials to the received data storing portion 403. The received data storing portion 403 keeps the materials in detailed files, and makes data for the booth controller and transmits the data to the booth controller interface 302.

Processes of inquiring the numbers of a credit card, an exemption card, and a discount card are as follows. When the credit card, the exemption card, and the discount card are used during the collection of the toll, the lane controllers 121 and 201 receive the periodical data polling generated in the communication processing device of the booth computers 111 and 211, and transfer the serial number data of the cards to the booth computers 111 and 211. When the data is transferred by the lane controllers 101, 121, and 201, the communication processing device of the booth computers 111 and 211 receives the data transmitted by the lane controllers through the data receiving portion 701 of the communication firmware portion 304 and transmits the same data to the lane controller interface 301. The lane data distributing portion 401 receives the data through the lane data transmitting and receiving portion 402, analyzes the data, and transmits the received card serial number confirming materials to the card inquiring portion 404. The card inquiring portion 404 searches the black list (B/L) table for credit cards, the exemption cards, and the discount cards and returns the result. The lane data distributing portion 401 transmits the returned table to the communication firmware portion 304 through the lane data transmitting and receiving portion 402. The communication firmware portion 304 transfers card inquiry result data to the lane controllers 121 and 201 through the data transmitting portion 702.

Processes of receiving device fault data (repair data) are described as follows. When a fault occurs in one of the lane controllers 101, 121, and 201, the device fault data is transferred to the booth computers 111 and 211. The communication processing device of the booth computers 111 and 211 receives the data transmitted by the lane controllers through the data receiving portion 701 of the communication firmware portion 304 and transmits the same data to the lane controller interface 301. The lane data distributing portion 401 receives the data through the lane data transmitting and receiving portion 402, analyzes the data, and transmits the received accident data to the received data storing portion 403. The received data storing portion 403 keeps the device fault data in detailed files and transmits the device fault data to the booth controller interface 302 and the lane state managing portion 406. The lane state managing portion 406 displays each lane state on a screen and records the lane data in the lane state table.

Processes of transferring booth controller materials are as follows. All the data transmitted by the lane controllers 101, 121, and 201 is immediately transmitted from the received data storing is portion 403 to the booth controller interface 302. The transmitted data, the priority order of which is determined in the transmitted data selecting portion 504, is transmitted to the booth controller interface controlling portion 501, and to the booth controller data transmitting and receiving portion 505, and is displayed as soon as materials are generated in the booth controllers 112 and 212.

As described above, according to the communication processing device of the toll collecting system according to the present invention, the operation state of the lane controllers can be monitored in real time and the booth computer which controls the toll collecting system can effectively transmit data to and receive data from the lane controllers, the booth controllers, and the connected peripheral equipments.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. A communication processing device included in a booth computer for controlling a toll collecting operation in a toll collecting system, said communication processing device comprising:

a communication firmware portion for transmitting data to and receiving data from a predetermined number of lane controllers which control equipments installed respectively in toll collection lanes, and for detecting and correcting errors in communication;

a lane controller interface for analyzing the data transmitted from said communication firmware portion, distributing the data to various processing devices in the booth computer, and transmitting predetermined commands and data from the processing devices in the booth computer to the lane controllers through said communication firmware portion;

a lower interface operating state managing portion for receiving commands from a user, controlling a communication state, and providing the result to the user; and a booth controller interface for transmitting to a booth controller initializing data representing a state of each lane, booth control data including an equipment state of each lane received from said lane controller interface, and working state data transmitted from said lower interface operating state managing portion.

2. The communication processing device of claim 1, further comprised of said lane controller interface comprising:

a lane data transmitting and receiving portion for transmitting lane data to and receiving lane data from said communication firmware portion;

a lane data distributing portion for receiving the lane data from said lane data transmitting and receiving portion, analyzing the lane data, and distributing the lane data to a corresponding process module;

a card inquiring portion for indicating whether a card number is included in a blacklist indicating a list of card numbers prohibited from use, when the lane data received from said lane data distributing portion is the card number;

a table managing portion for adding, deleting, changing, and searching for items included in various tables including lane state basis items, a card blacklist, and a lane state;

a received data storing portion for storing the lane data received from said lane data distributing portion in a detailed file, when the lane data received from said lane data distributing portion is to be stored, and for transmitting booth controlling data, data in which specific items are generated, and credit card use results data to a corresponding process module, from among the data to be stored;

a lane state managing portion for receiving lane state data from said lane data distributing portion and the data in which specific items are generated from the received data storing portion and recording the data of said specific items in a lane state file, informing the user of said specific items, or generating work completion instructing commands;

a credit card processing portion for receiving credit card use results data from said received data storing portion, processing the data on-line, and recording the contents thereof on a file; and a material restoring portion, for restoring the contents of the lane state file and the detailed file, when an accident occurs in the materials of one of those files.

3. The communication processing device of claim I, further comprised of said booth controller interface comprising:

a booth controller data transmitting and receiving portion for transmitting data to and receiving data from the booth controller;

an initializing data selecting portion for selecting initializing data of the state of each lane and transmitting the selected data to the booth controller through said booth controller data transmitting and receiving portion, when data received from said booth controller data transmitting and receiving portion is a request for initializing data;

a port initializing portion for initializing the port of the booth controller;

a transmission data selecting portion for selecting urgent data among the booth controlling data including the equipment state of each lane received from said lane controller interface; and a booth controller interface controlling portion for commanding the port initializing portion to be executed, transmitting the booth controlling data selected in said transmission data selecting portion and the working state data received from said lower interface operating state managing portion to the booth controller through said booth controller data transmitting and receiving portion, and receiving the result from said booth controller data transmitting and receiving portion.

4. The communication processing device of claim I, further comprised of said lower interface operating state managing portion comprising:

an operating state providing portion for providing a present lane operating state to a user according to commands of the user;

a table confirming portion for commanding the reception of the table kept in the lane controller according to commands of the user, comparing the table kept in the lane controller with the table kept in the booth computer, and providing the result of the comparison to the user;

an accumulated data re-polling portion for requesting from the data of said lane controller interface with respect to working numbers optionally designated by the user and providing the result to the user;

a booth controller interface managing portion for connecting, disconnecting, or testing the connection with said booth controller interface according to the commands of the user;

a guarantee transfer serial number transmitting portion for transmitting a transfer serial number designated by the user to the lane controller through said lane controller interface and guaranteeing the transfer serial number;

a lower interface process managing portion for connecting or interrupts communication with the lane controller according to the commands of the user; and a lower communication line testing portion for testing the line state of the interface with the lane controller and the operating state of the interface with peripheral equipment, according to the commands of the user.

5. The communication processing device of claim 1, further comprised of said communication firmware portion comprising:

a data receiving portion for receiving and processing data from the lane controller so that received data may be used by programs in the booth computer;

a data transmitting portion for arranging data into transmission frames so as to be transferred in a communication firmware level and transmitting data; and an error checking portion for calculating the value of an error detection code included in transmitted and received data and checking transmitted serial numbers.

6. The communication processing device of claim 1, wherein said communication processing device is a booth computer.

7. The communication processing device of claim 1, wherein said booth computer and booth controller comprise a booth device in communication with an entrance lane and an exit lane device.

8. A toll collecting system for toll collection of vehicles on a toll road, comprising:

an entrance lane device installed at the entrance gate for transmitting entrance information to the vehicle which enters the entrance gate;

an exit lane device installed at the exit gate for collecting the toll from the vehicle which exits the exit gate;

a booth device controlling said entrance lane device and said exit lane device for toll collection of the vehicle which enters the entrance gate and exits the exit lane of the toll road;

said entrance lane device comprising:

a first vehicle sensor for sensing the vehicle which enters the entrance lane;

a second vehicle sensor for sensing the vehicle which departs from the entrance lane;

an entrance lane controller for controlling operation of said first vehicle sensor and said second vehicle sensor, said entrance lane controller receiving periodical data polling generated from said booth device, and then said entrance lane controller transferring data of said entrance lane to said booth device, said booth device processing the data and then displaying the processed data of said entrance lane controller, the data of said entrance lane including toll collecting materials of the vehicle; and a pass issuer connected to said entrance lane controller for giving the pass to the driver of the vehicle which enters the entrance lane in response to receipt of a vehicle arriving signal from said first vehicle sensor;

said exit lane device comprising:

a third vehicle sensor for sensing the vehicle which arrives at the exit gate;

a pass processor for processing the entrance information of the vehicle which arrives at the exit gate from the pass received from the driver of the vehicle; and an exit lane controller for controlling said third vehicle sensor and said pass processor to collect the toll from the vehicle, said exit lane controller receiving periodical data polling generated from said booth device, and then said exit lane controller transferring data of said entrance lane to said booth device, said booth device processing and then displaying the processed data of said exit lane controller, the data of said exit lane including toll collecting materials of the vehicle.

9. The toll collecting system of claim 8, further comprised of said exit lane device additionally comprising a receipt issuer connected to said exit lane controller for issuing a receipt in accordance with inputs from the clerk stationed at the exit gate.

10. The toll collecting system of claim 8, further comprised of said exit lane device additionally comprising a payment processor connected to said exit lane controller for collecting the toll in the form of a pre-paid ticket.

11. The toll collecting system of claim 8, said booth device comprising a booth computer and a booth controller, said booth computer comprising:

a communication firmware portion for transmitting data to and receiving data from a predetermined number of lane controllers which control equipments installed respectively in toll collection lanes, and for detecting and correcting errors in communication;

a lane controller interface for analyzing the data transmitted from said communication firmware portion, distributing the data to various processing devices in the booth computer, and transmitting predetermined commands and data from the processing devices in the booth computer to the lane controllers through said communication firmware portion;

a lower interface operating state managing portion for receiving commands from a user, controlling a communication state, and providing the result to the user; and a booth controller interface for transmitting to a booth controller initializing data representing a state of each lane, booth control data including an equipment state of each lane received from the lane controller interface, and working state data transmitted from said lower interface operating state managing portion.

12. A communication processing device included in a booth computer for controlling a toll collecting operation in one of a closed-type toll collecting system and an open-type toll collecting system, said communication processing device comprising:

a communication firmware portion for transmitting data to and receiving data from an entrance lane controller and an exit lane controller which control equipments installed respectively in toll collection lanes, and for detecting and correcting errors in communication;

a lane controller interface for analyzing data transmitted from said communication firmware portion, distributing the data to processing devices in the booth computer, and transmitting predetermined commands and data from the processing devices in the booth computer to the entrance and exit lane controllers through said communication firmware portion;

a lower interface operating state managing portion for receiving commands from a user, controlling a communication state, and providing the result to the user; and a booth controller interface for transmitting initializing data indicating the status of each lane to a booth controller, booth control data including an equipment state of each lane received from said lane controller interface, and working state data transmitted from said lower interface operating state managing portion.

13. The communication processing device of claim 12, further comprised of said lane controller interface comprising:

a lane data transmitting and receiving portion for transmitting lane data to and receiving lane data from said communication firmware portion;

a lane data distributing portion for receiving the lane data from said lane data transmitting and receiving portion, and analyzing the lane data for distribution;

a card inquiring portion for indicating whether a card number is included in a blacklist indicating a list of card numbers prohibited from use, when the lane data received from said lane data distributing portion is the card number;

a table managing portion for adding, deleting, changing, and searching for items included in various tables including lane state basis items, a card blacklist, and a lane state;

a received data storing portion for storing lane data received from said lane data distributing portion in a detailed file, when the lane data received from said lane data distributing portion is to be stored, and for transmitting booth controlling data, data in which specific items are generated, and credit card use results data to a corresponding process module, from among the data to be stored;

a lane state managing portion for receiving lane state data from said lane data distributing portion and the data in which specific items are generated from said received data storing portion and recording the data of said specific items in a lane state file, informing the user of said specific items, or generating work completion instructing commands;

a credit card processing portion for receiving credit card use results data from said received data storing portion, processing the data on-line, and recording the contents thereof on a file; and a material restoring portion for restoring the contents of the lane state file and the detailed file, when an accident occurs in the materials of one of those files.

14. The communication processing device of claim 12, further comprised of said booth controller interface comprising:

a booth controller data transmitting and receiving portion for transmitting data to and receiving data from the booth controller;

an initializing data selecting portion for selecting initializing data of the state of each lane and transmitting the selected data to the booth controller through said booth controller data transmitting and receiving portion, when data received from said booth controller data transmitting and receiving portion is a request for initializing data;

a port initializing portion for initializing the port of the booth controller;

a transmission data selecting portion for selecting urgent data among the booth controlling data including the equipment state of each lane received from said lane controller interface; and a booth controller interface controlling portion for commanding the port initializing portion to be executed, transmitting the booth controlling data selected in the transmission data selecting portion and the working state data received from said lower interface operating state managing portion to the booth controller through said booth controller data transmitting and receiving portion, and receiving the result from said booth controller data transmitting and receiving portion.

15. The communication processing device of claim 12, further comprised of said lower interface operating state managing portion comprising:

an operating state providing portion for providing a present lane operating state to a user according to commands of the user;

a table confirming portion for commanding the reception of the table kept in the lane controller according to commands of the user, comparing the table kept in the lane controller with the table kept in the booth computer, and providing the result of the comparison to the user;

an accumulated data re-polling portion for requesting from the data of said lane controller interface with respect to working numbers optionally designated by the user and providing the result to the user;

a booth controller interface managing portion for connecting, disconnecting, or testing the connection with said booth controller interface according to the commands of the user;

a guarantee transfer serial number transmitting portion for transmitting a transfer serial number designated by the user to the lane controller through the lane controller interface and guaranteeing the transfer serial number;

a lower interface process managing portion for connecting or interrupts communication with the lane controller according to the commands of the user; and a lower communication line testing portion for testing the line state of the interface with the lane controller and the operating state of the interface with peripheral equipment, according to the commands of the user.

16. The communication processing device of claim 12, further comprised of said communication firmware portion comprising:

a data receiving portion for receiving and processing data from the lane controller so that received data may be used by programs in the booth computer;

a data transmitting portion for arranging data into transmission frames so as to be transferred in a communication firmware level and transmitting data; and an error checking portion for calculating the value of an error detection code included in transmitted and received data and checking transmitted serial numbers.

17. A method, comprising the steps of:

transmitting and receiving data between a communication firmware portion of a communication processing device and a predetermined number of lane controllers of said communication processing device which controls equipment installed respectively in toll collection lanes, said communication processing device included in a booth computer for controlling a toll collecting operation in a toll collecting system;

detecting and correcting errors in communication by said communication firmware portion;

analyzing with a lane controller interface of said communication processing device, the data transmitted from said communication firmware portion;

distributing with said lane controller interface of said communication processing device the data to various processing devices in the booth computer;

transmitting predetermined commands and data from the processing devices in the booth computer to the lane controllers through said communication firmware portion;

receiving commands from a user, controlling a communication state, and providing the result to the user through a lower interface operating state managing portion; and transmitting from a booth controller interface of said communication processing device to a booth controller initializing data representing a state of each lane, booth control data including an equipment state of each lane received from said lane controller interface, and working state data transmitted from said lower interface operating state managing portion.

18. The method of claim 17, further comprising the steps of:

transmitting lane data from a lane data transmitting and receiving portion of said lane controller interface to said communication firmware portion;

receiving lane data by said transmitting and receiving portion from said communication firmware portion;

receiving and analyzing the lane data by a lane data distributing portion of said lane controller interface from said lane data transmitting and receiving portion;

distributing the lane data from said lane data distributing portion to a corresponding process module;

receiving a card number by a card inquiring portion of said lane controller interface from said lane data distributing portion;

verifying through said card inquiring portion whether a card number is included in a blacklist indicating a list of card numbers prohibited from use;

adding, deleting, changing, and searching through a table managing portion of said lane controller interface for items included in various tables including lane state basis items, a card blacklist, and a lane state;

storing the lane data by a received data storing portion of said lane controller interface, acquired from said lane data distributing portion in a detailed file; and transmitting a portion of the stored lane data in said received data storing portion to process modules, said portion of the stored lane data including booth controlling data, data in which specific items are generated, and credit card use results data.

19. The method of claim 18, further comprising the steps of:

receiving lane state data by a lane state managing portion of said lane controller interface from said lane data distributing portion;

receiving by said lane state managing portion, data in which specific items are generated from said received data storing portion; and recording the data of said specific items in a lane state file and informing the user of said specific items.

20. The method of claim 19, further comprising the steps of:

receiving by a credit card processing portion of said lane controller interface, card use results data from said received data storing portion, processing the data on-line, and recording the contents thereof on a file; and rebuilding through a material restoring portion, the contents of the lane state file and the detailed file, when an accident occurs in the materials of one of those files.

* * * * *